United States Patent [19]

Purfurst et al.

[11] Patent Number: 4,843,878

[45] Date of Patent: Jul. 4, 1989

[54] METHOD AND APPARATUS FOR INSTANTANEOUSLY INDICATING PERMEABILITY AND HORNER PLOT SLOPE RELATING TO FORMATION TESTING

[75] Inventors: Ernest H. Purfurst, Houston; Gary K. Baird, Richmond, both of Tex.

[73] Assignee: Halliburton Logging Services, Inc., Houston, Tex.

[21] Appl. No.: 247,542

[22] Filed: Sep. 22, 1988

[51] Int. Cl.[4] ..... E21B 49/00

[52] U.S. Cl. ..... 73/155

[58] Field of Search ..... 73/155, 38; 364/422; 166/250

[56] References Cited

U.S. PATENT DOCUMENTS 4,597,290 7/1986 Bourdet et al. ..... 73/155

4,745,802 5/1988 Purfurst ..... 73/155

*Primary Examiner*—Jerry W. Myracle

*Attorney, Agent, or Firm*—William J. Beard

[57] ABSTRACT

For use in a formation testing tool adapted to be lowered into a borehole on a logging cable, apparatus is set forth which conducts formation measurements including extension of a snorkel into a formation of interest, initiating a drawdown beginning at a first time and terminating at a second time. The flow rate in the drawdown is measured. The present apparatus and method further determine a Horner Plot for that particular formation, and measure the slope of the Horner Plot and also extend the Horner Plot to thereby obtain the intercept representative of final formation pressure after build-up. A relationship is evaluated, and computer circuitry for determining permeability responds to the slope of the Horner Plot, formation fluid viscosity, pretest flow rate and formation thickness to yield permeability.

15 Claims, 2 Drawing Sheets

METHOD AND APPARATUS FOR INSTANTANEOUSLY INDICATING PERMEABILITY AND HORNER PLOT SLOPE RELATING TO FORMATION TESTING

BACKGROUND OF THE DISCLOSURE

The present disclosure is directed to test data evaluations which are obtained in testing after an oil well has been drilled. During the drilling of a well after certain formations have been penetrated, a particular formation of interest will be tested to determine if it has sufficient porosity to produce valuable petroleum products. Present procedures involve the use of a formation tester (FT) which is typically lowered on a wireline into the open hole. This is a device which incorporates a snorkel which is extended in a known fashion into the formation to expedite formation fluid flow. The FT encloses one or more sample chambers which are filled. A valve is open in the FT to introduce measurements associated with this activity include the measurement of pressure both before and after the test, elapsed time required to obtain a specified volume of test fluid, fluid viscosity and other variables. The present procedure utilizes certain measurements obtained from the FT which yield an instantaneous indication of formation permeability.

In times past, permeability calculations ordinarily were processed only after the FT had completed the various testing and sampling procedures. Typically, the post sampling calculations of data were performed at or near the well site after removal of the FT, or were performed much later. Determinations of permeability after removal of the FT from the open hole well created a great deal of risk. For instance, data was normally obtained from the uncased well borehole before casing or other completion procedures were initiated. If too much time passed, leaving the well borehole in the open condition was viewed as risky. On the other side of the coin, if the permeability could be obtained while the FT were still in the borehole, additional tests or more accurately determined completion procedures could then be implemented. Therefore, the time lag in obtaining a final permeability calculation from data derived from a first run was so great that the delay was substantial and risky. Regrettably, the FT, once removed from the well, typically is removed from the well site. Moreover, delays in completion of such testing are expensive. Delays are expensive because the well is maintained in an open hole condition which runs some risk of sidewall collapse or directed circulation to various formations penetrated by the well, and it also ties up rig time. Rig cost is normally proportionate to time. Accordingly, if substantial time elapses between first use of an FT, subsequent determination of formation data necessitating a second use of the FT after removal, a substantial cost increment is incurred.

The present apparatus is a system, and related method, as will be described, for obtaining measurements dynamically in the downhole context so instantaneous determinations of permeability can be obtained. This involves conducting a pretest, measuring the flow rate, measuring the duration of the pretest, and also taking pressure measurements before and after the pretest whereby permeability values can be calculated by means of a computer at the surface. Other data used in this determination relate to making the Horner Plot. The present method and apparatus enable an instantaneous indication of permeability from the several variables, even while the FT is in the well and while rig time is held to a minimum.

The present disclosure is therefore directed to a method of obtaining sufficient data to mathematically compile a Horner Plot and to make other measurements so that permeability can be calculated while a formation test device is in the well borehole. This cuts down on wasted rig time. Instantaneous indications of permeability can enable decisions to be made immediately.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
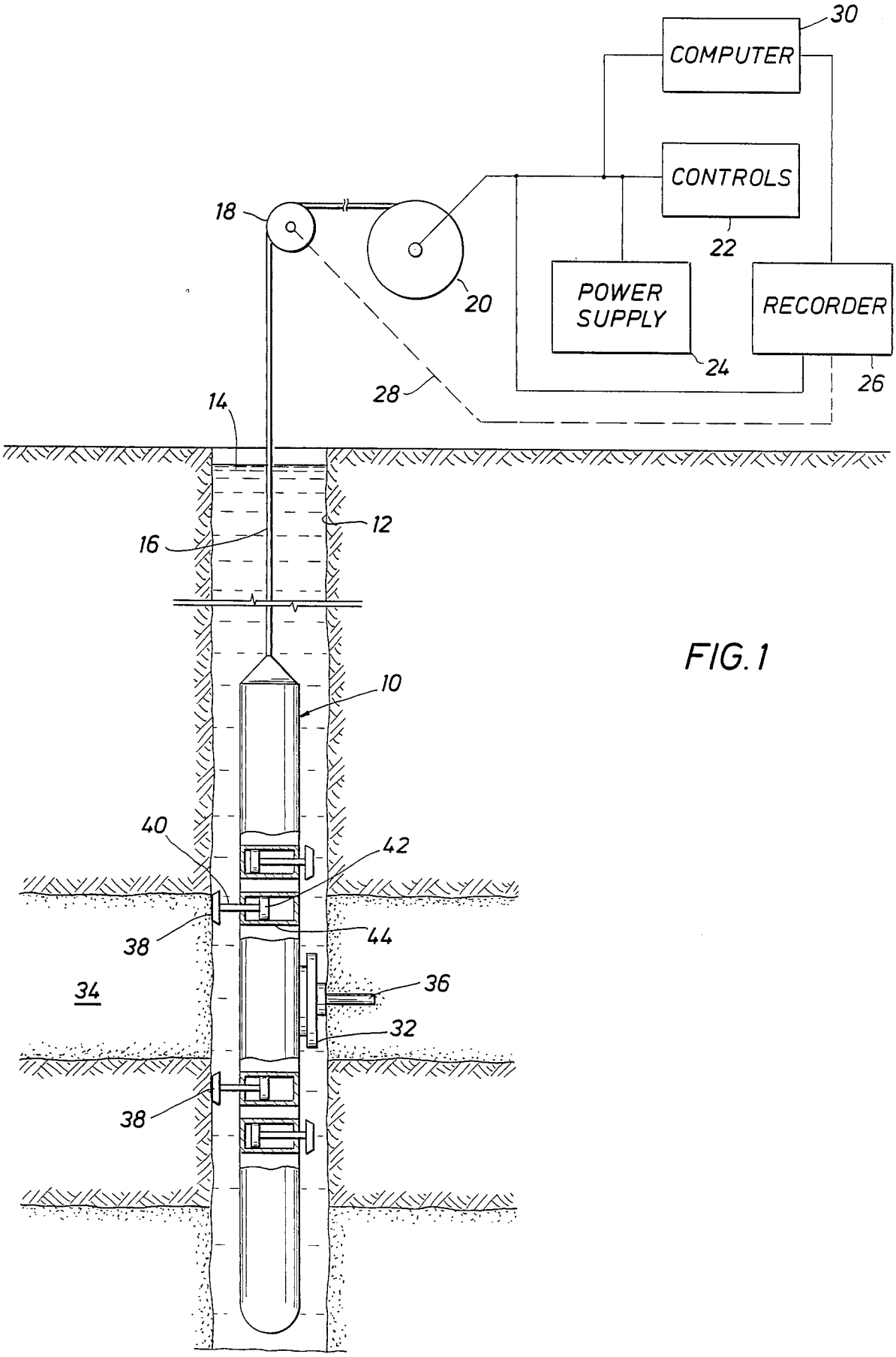

IN THE DRAWINGS:

FIG. 1 shows a formation tester suspended in a well bore having a probe which extends a snorkel into a formation of interest to make measurements therein and further shows a computer which instantaneously determines the permeability in accordance with the relationships described herein.

Figure 2:
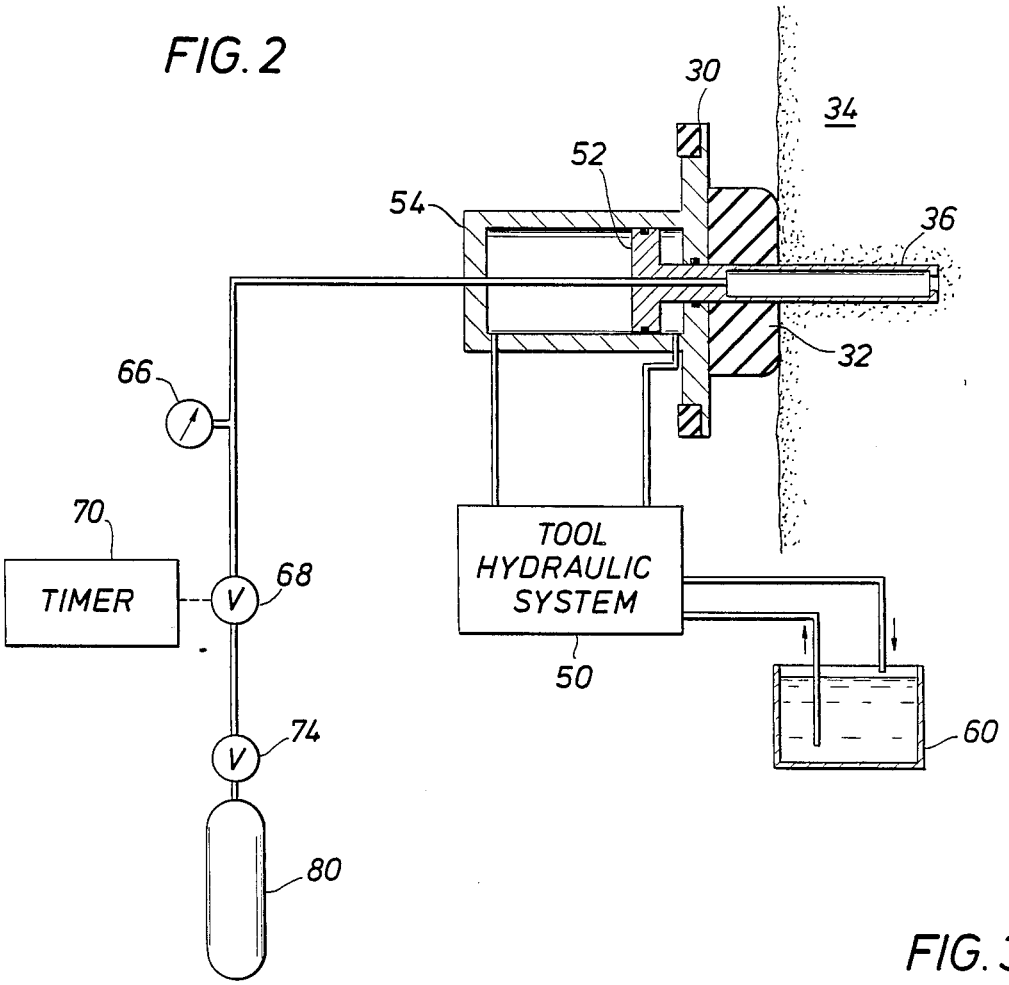

FIG. 2 is a partial schematic of the tool hydraulic system showing a packer isolated probe mounted snorkel extending into a formation for obtaining fluid to enable measurement of formation pressure and recovery of a fluid sample over a period of time.

Figure 3:
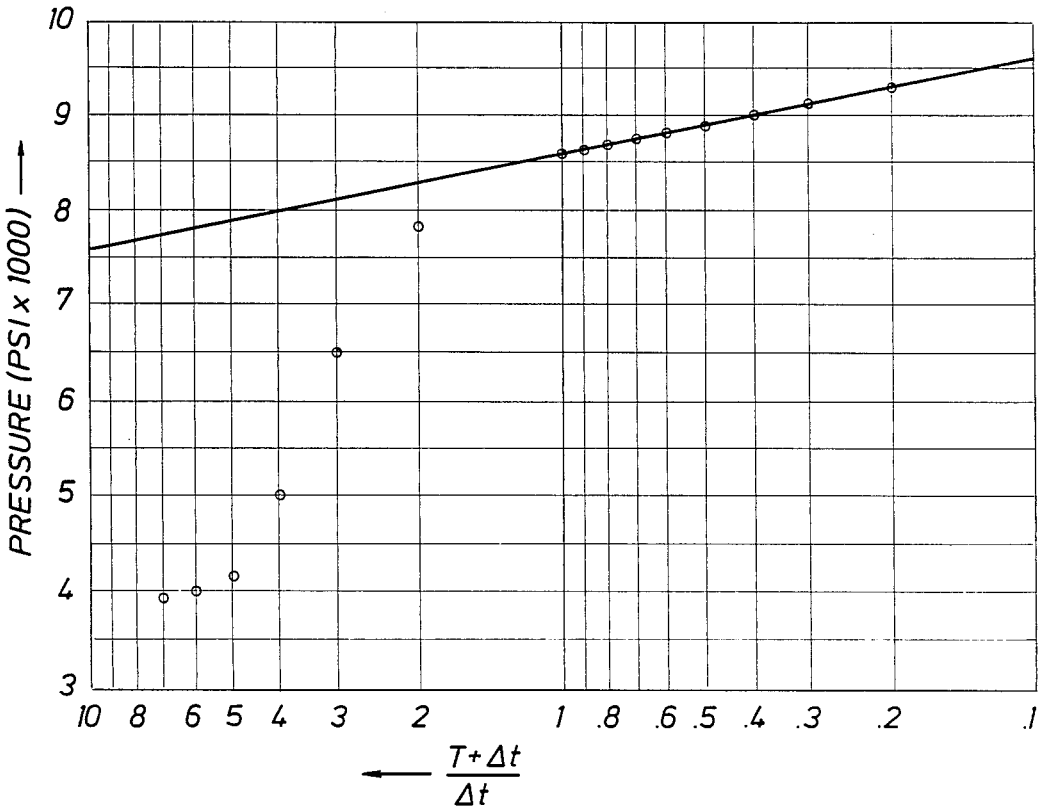

FIG. 3 is an exemplary Horner Plot using formation tester data including pretest or posttest drawdown and pressure build up.

DETAILED DESCRIPTION OF THE PREFERRED EMBODIMENT

Attention is directed first to FIG. 1 of the drawings where the numeral 10 identifies the FT of the present invention suspended in a well borehole 12. The well is an open hole at this stage of proceedings to permit formations adjacent to the well 12 to be tested. The well is typically filled with drilling fluid indicated at 14. The formation tester is suspended on an armored logging cable. The cable 16 passes over a sheave 18 and is spooled on a storage reel or drum 20. Operation is under direction of surface located controls 22. Power for operation is provided by a power supply 24. The system incorporates a recorder 26 which records various signals whic are furnished from the FT tool 10. The recorder is provided with a signal indicative of tool depth in the well by means of a depth measuring apparatus 28 which is connected with the sheath 18. A computer 30 provides data for the recorder 26 in the fashion to be described below including measurements of permeability. The permeability value thus determined is stored on the recorder, either placed in the form of a strip chart recording or alternatively, is recorded on magnetic tape.

Attention is directed to the FT tool 10. It incorporates a laterally extending probe packer 32 which is positioned opposite a formation 34. The FT is used to test the formation 34 and provide data from the formation. A snorkel 36 is extended into the formation to obtain formation fluid. The tool is held momentarily stationary by a pair of backup shoes 38 which are mounted on suitable piston rods 40 driven by pistons 42. The pistons are located in suitable cylinders 44. The stabilization assures that the tool does not shift while the snorkel 36 is extended into the formation 34.

The closed housing of the FT tool 10 encloses and supports a tool hydraulic system gradually indicated at 50 of the drawings. The tool hydraulic system connects with the probe 36 as shown. The probe 36 is FIG. 2 is extended by means of a piston 52 within a cylinder 54. Operation of this apparatus is believed to be well understood, and a representative FT tool showing such a system is identified in U.S. Pat. No. 4,745,802 which is owned by the Assignee of the present disclosure. The computer and control system provide a control signal which is implemented by the hydraulic system for operation of the snorkel 36 as discussed. The tool hydraulic system incorporates multiple components including a sump 60. The tool hydraulic system 50 enables operation of the equipment to deliver the formation sample through a sample flow line 64. The sample flow line is connected with a pressure gauge 66. The gauge 66 provides an indication of pressure in the sample line and hence pressure at the tip of the snorkel. If the snorkel is extended into the formation 34, and suitable isolation from well borehole pressur is accomplished, the pressure measuring device 66 will measure the pressure of fluid in the formation.

A valve 74 is connected to the sample line. The sample line delivers fluid into a drawdown chamber enabling a measured volume of test fluid to enter the FT tool through the snorkel 36. The valve 74 permits a large volume of formation fluid to be delivered into a storage container 80. This stores the sample which is obtained from the formation through the snorkel 36. Additional storage containers may be included and are independently operated under control of the hydraulic system 50.

The foregoing describes the apparatus which is used to carry out the method of the present invention, however, some information is helpful to set the stage for describing the measurements which are normally made through the practice of this method and to described the determinations which ultimately lead to formation permeabilities.

In 1951, D. R. Horner authored a paper which sets out the mathematical relationship for pressure interpretation of data obtained by downhole pressure testing. This involves a pressure recording where time is the abscissa and pressure is the ordinate. Important values obtained from a Horner Plot are the initial shut-in pressure and final shut-in pressure, and instantaneous values of pressure. The Horner Plot is typically compiled by graphing the data. The preferred presentation of the Horner Plot utilizes semilog paper where the abscissa is the log scale is (T+Dt) (1/Dt) while Pressure (P) is the linear scale or the ordinate. Ideally, a straight line is projected in the case of the uniform reservoir with a single fluid drive. Curve projection can be made so that the curve end corresponds to the passage of an infinite interval which provides fluid pressure measurement at the intercept. As will be understood, this intercept is represented by plotting measurements on a semilog plot to thereby represent the intercept as a useful variable in practice of the present invention. The intercept is represented by the symbol b. A pretest sequence occurring at a time t is defined; the pretest flow rate is given by the symbol Q and is measured in cc/sec. The incremental time after the shut-in (filling the drawdown chamber 90) is represented by Dt. This enables a first equation to be defined, namely Equation 1 which in turn leads to Equations 2 and 3.

$$X = (T + Dt)/Dt \tag{1}$$

$$Y = \mathrm{Log}_{10}(X) \tag{2}$$

$$K = 88.4Q\mu/-mh \tag{3}$$

$$M = \frac{(\Sigma Y)(\Sigma P)/N - \Sigma(YP)}{(\Sigma Y)^2/N - \Sigma Y^2} \tag{4}$$

$$b = \frac{[\Sigma P - m(\Sigma Y)]}{N} \tag{5}$$

In Equation 3 above, formation or zone thickness is represented by H and is measured in feet. Formation fluid viscosity in centipoise is represented by $\mu$. The slope of the Horner Plot is indicated by the symbol m. The Horner intercept is given by the symbol b.

The data necessary for calculation of the value X can be measured and thus this value can be calculated in accordance with Equation 1. That leads immediately to the determination of the value Y from Equation 2. A Horner Plot (see FIG. 3) fits the multiple data points to form a line using the least squares fit method. The data of FIG. 3 is plotted to obtain the value for m or the slope. The slope m is given in Equation 4 where N is the number of data points and P is the discrete pressure data values.

Going now to Equation 3, the slope m is determined as just noted. The flow rate can be readily measured by the FT and hence the pretest flow rate Q is determined. This leaves only two values, namely $\mu$ which is formation fluid viscosity and formation zone thickness or H. Formation thickness is often known from other logging activity. For instance, if the well is drilled in a geological region where the formation is known, thickness of the formation 34 can be reasonably estimated in advance. Alternatively, additional logging tools run in advance of the FT tool can locate in the various formations and determine their thicknesses. Care must be taken when determining formation zone thickness due to layers of impermeable rock or shale in the zone which can distort the true value of permeability. Layers such as these may not be detected by other logging systems. This value H is thus determined in advance.

In some instances, it is necessary to make assumptions of the values which are shown in Equation 3. This is most especially true of formation fluid viscosity. If no value is measured often the value can be determined by the fluids known to be in the vicinity or in other producing formations or at similar depths. In lieu of that, an assumed value of viscosity is utilized and is input to Equation 3 to determine the permeability K. The fluid is assumed to be filtrate with about 18% concentration of NaCl. This assumed filtrate, subjected to a temperature associated with easily measured well dept, has a viscosity which is easily determined.

The value of Equation 3 is thus determined after making the necessary measurements. The measurements to utilize Equation 3 involve conducting the pretest to fill the drawdown chamber 90 so that pretest flow rate is determined, and this is measured over an interval of time between opening and closing the pretest chamber, otherwise measuring Dt. Recall that the symbol b represents the intercept or the final built up pressure of the formation. So to speak, it is the extension of the Horner Plot to the intercept. Values of permeability K and the intercept are preferably determined periodically as for instance once per second as the pressure build-up occurs. In other words, while the pressure build-up will start at a high rate, it then decelerates as the maximum pressure is approached. Equations 3 and 4 are calculated periodically while the permeability converges to a numeric value as the pressure approaches some final value. The values are assumed to be correct when changes are minimal. This value can be assigned as the intercept of the Horner Plot, or the value b.

The computer 30, shown in FIG. 1, is utilized to determine these values of m and b from the Horner Plot. The computer provides a continual output of permeability K and intercept b after shut-in occurs. These calculations are preferably run periodically, even often as 2.5 seconds apart. The final value of b can be accepted when the rate of increase of pressure (as a function of time) decreases below some assigned minimal value. For instance, the pressure may increase at a rate of about 200 psi per second immediately after shut-in but will ultimately decelerate; an arbitrary value of pressure change per second will suffice as an exemplary minimal rate of increase.

Another aspect of the present procedure is providing an output while the FT is used with the snorkel extended, the chamber 80 closed, and pressure reading still made available. The value of K and b are determined at the surface and output to the operator. At this point, the operator is then provided with substantial data enabling the operator at the surface to know instantaneously whether or not to conduct further tests or to move the FT from the illustrated location and test another formation. Alternately, the operator will see indications in the data including indications of K and b which tell the operator that the formation is of interest for subsequent production. This can then be used to determine the casing program and perforations to be placed through the casing into the formation 34. The phrase Horner Plot as used in the claims refers to a Horner Plot and the data underlying such a plot.

While the foregoing is directed to the preferred embodiment, the scope thereof is determined by the claims which follow.

What is claimed is:

1. A method for determining permeability of a formation wherein the method comprises the steps of:

(a) by use of a formation testing apparatus lowered in an open oil well borehole, conducting formation pressure tests over an interval of time from formations of interest adjacent the borehole and obtaining therefrom data indicative of flow rate over a measured time interval for the formation;

(b) forming a Horner Plot utilizing the flow rate and time thereof;

(c) measuring the slope of the Horner Plot; and (d) from the Horner Plot slope and formation flow rate determining the permeability of the formation.

2. The method of claim 1 wherein the step of determining permeability determines permeability as a function of formation thickness.

3. The method of claim 2 wherein the method of determining permeability includes a preliminary step of measuring formation thickness.

4. The method of claim 2 wherein the formation thickness is determined in relation to adjacent formation well data.

5. The method of claim 1 including the step of determining permeability as a function of formation fluid viscosity.

6. The method of claim 5 including the step of capturing formation fluid and thereafter measuring the viscosity and utilizing the measure of viscosity as a factor in determination of permeability.

7. The method of claim 1 further including the step of extending the Horner Plot to an intercept representative of final built-up pressure and forming an output indication thereof in real time.

8. The method of claim 1 including the initial step of positioning the formation testing apparatus opposite the formation of interest, extending a snorkel into that formation to obtain formation fluid subject to fluid pressure drive solely resulting from the formation, conducting a flow from the formation into the snorkel for a selected time interval, and measuring the formation pressure at the snorkel at the beginning and end of the flow test.

9. The method of claim 8 including the step of determining $(X=T+Dt) \div Dt$ where T=the drawdown time, and Dt=the time after drawdown shut-in.

10. The method of claim 8 including the step of determining the slope of the Horner Plot for the formation of interest.

11. The method of claim 10 including the step of determining permeability after determining the Horner Plot slope.

12. An apparatus for providing an indication of premeability of a formation, the apparatus comprising:

(a) an elongate formation testing tool adapted to be lowered on a wireline into an open hole well borehole;

(b) a laterally extending snorkel supported by said tool and adapted to extend into a formation of interest to measure formation pressure at a depth in the formation sufficient to isolate the measurement from pressure in the borehole;

(c) test means for conducting a formation flow test;

(d) timing means for measuring the duration of the flow test beginning at a starting time and ending at a finish time wherein a time interval elapses and the flow test is conducted for that interval;

(e) means for determining a Horner Plot derived from measurements from formation flow rate and formation test time;

(f) means for forming a Horner Plot utilizing the data obtained from the formation wherein the Horner Plot has a slope; and (g) means for determining formation permeability as a function of the slope of the Horner Plot and formation flow rate.

13. The apparatus of claim 12 further including means for indicating the depth of the formation of interest so that formation permeability can be obtained as a function of depth in the borehole.

14. The apparatus of claim 13 further including means for determining the Horner Plot intercept, and wherein said means represents final formation built-up pressure as the intercept.

15. The apparatus of claim 14 including means for forming a visual representation of depth and permeability formation data.

* * * * *